US005911441A

United States Patent [19]

Yamamoto et al.

[11] Patent Number: 5,911,441

[45] Date of Patent: Jun. 15, 1999

[54] ZIPPERED THREE-RING BINDER CARRYING CASE WITH ADDITIONAL EXTERNAL ZIPPERED COVER FOR NOTEPAD

[75] Inventors: Norman Curtis Yamamoto, Yorba Linda; Bruce A. Carter, Lake Forest, both of Calif.

[73] Assignee: Avery Dennison Corporation, Pasadena, Calif.

[21] Appl. No.: 08/804,369

[22] Filed: Feb. 21, 1997

[51] Int. Cl.[6] ..... B42D 1/00

[52] U.S. Cl. ..... 281/15.1; 281/28; 402/70; 402/73

[58] Field of Search ..... 402/4, 70, 73; 281/15.1, 28; 190/102, 111, 115, 127, 902; 206/214, 576, 232, 473; D3/233; D19/26, 27

[56] References Cited

U.S. PATENT DOCUMENTS

| | | | |
|---|---|---|---|
| D. 303,548 | 9/1989 | Rexroat et al. . | |
| D. 349,514 | 8/1994 | Gotlund . | |
| 384,697 | 6/1888 | Kelly . | |
| 665,256 | 1/1901 | McComb . | |
| 676,857 | 6/1901 | White . | |
| 1,563,864 | 12/1925 | Juvet . | |
| 2,146,013 | 2/1939 | Goldblatt . | |
| 2,318,110 | 5/1943 | Sjobom . | |
| 2,318,192 | 5/1943 | Boelema, Jr. . | |
| 2,588,152 | 3/1952 | Newman . | |
| 2,636,751 | 4/1953 | Carlson . | |
| 2,716,985 | 9/1955 | Wolf . | |
| 2,742,070 | 4/1956 | Jones . | |
| 2,755,837 | 7/1956 | Kosek . | |
| 3,837,680 | 9/1974 | Cimini . | |
| 4,865,483 | 9/1989 | Snook . | |
| 4,984,924 | 1/1991 | Erlich . | |
| 5,160,001 | 11/1992 | Marceau | 190/102 |
| 5,174,674 | 12/1992 | Norwood . | |
| 5,186,565 | 2/1993 | Jack . | |
| 5,219,437 | 6/1993 | Moor . | |
| 5,232,301 | 8/1993 | Bianco . | |
| 5,240,340 | 8/1993 | Lynch et al. . | |
| 5,489,021 | 2/1996 | Wallingford | 206/214 |
| 5,489,120 | 2/1996 | Thornsburg . | |

*Primary Examiner*—Frances Han

*Attorney, Agent, or Firm*—Oppenheimer Wolff & Donnelly LLP

[57] ABSTRACT

The present invention provides an improved carrying case which is capable of storing a pad of fresh writing paper, wherein the pad of paper may be stored in a pocket that will enclose the pad and protect it from being exposed to the outside elements. The carrying case of the present invention provides the benefits that the notepad is easily accessible to the user, without having to open the case to expose the papers contained within the interior of the case. Thus, the user may write upon a fresh pad of paper without opening the interior of the carrying case. Further, the carrying case is sturdy enough so that the user can have a sufficiently stable surface to write upon the notepad without removing the notepad from its pocket.

21 Claims, 7 Drawing Sheets

FIG. 6
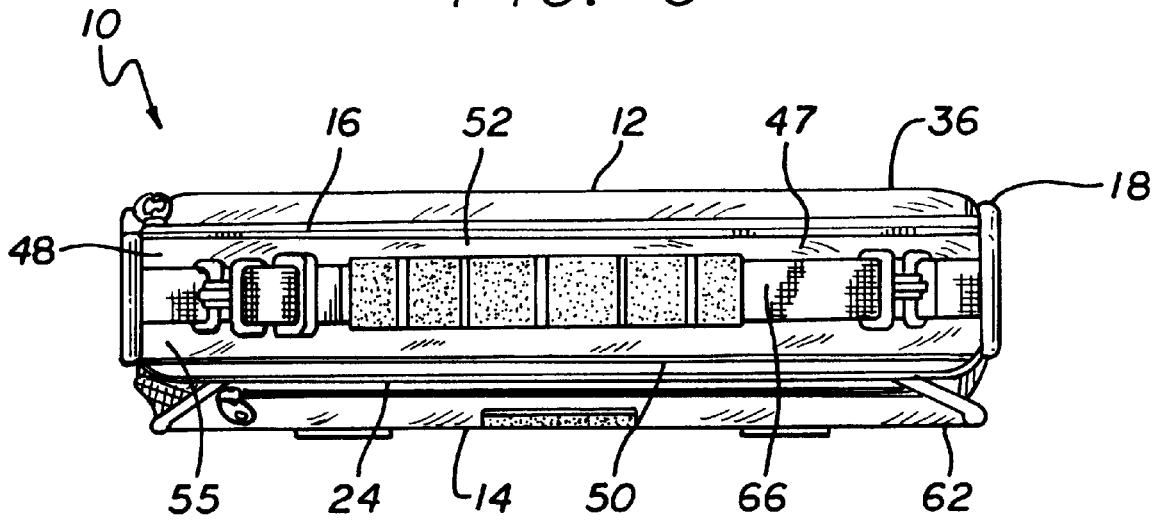
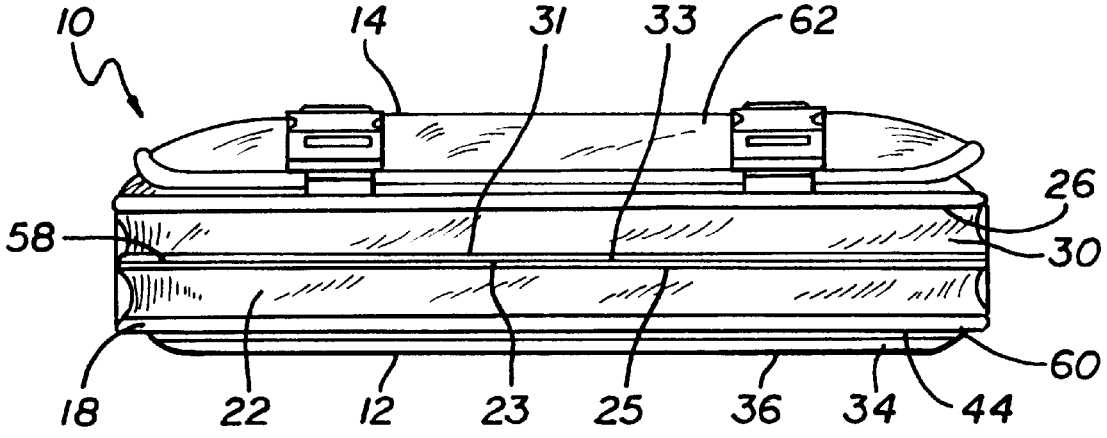
FIG. 7

ZIPPERED THREE-RING BINDER CARRYING CASE WITH ADDITIONAL EXTERNAL ZIPPERED COVER FOR NOTEPAD

FIELD OF THE INVENTION

The present invention relates in general to cases for carrying papers and more particularly to carrying cases for carrying papers contained within the interior of the carrying case having a zippered cover for containing a notepad on the outer surface of the carrying case such that the user may write on the notepad without having to open the interior of the carrying case.

BACKGROUND OF THE INVENTION

Increasingly, businesspersons and students are becoming more mobile. Business meetings are being conducted offsite—away from the person's regular place of business. Students often attend lectures and classes away from their regular routine classrooms. At these business meetings and lectures, and while traveling, these businesspersons and students have a definite need for a case for neatly carrying all of the papers and other items that they must carry with them. The carrying case must be capable of maintaining the papers in an organized fashion in a such a manner that the papers are easily accessible to the user in the manner selected by the user. Further, the carrying case should be lightweight, easy to carry, and have sufficient pockets and space to hold additional materials, such as pens, pencils, calculators, business cards and the like.

Although one main purpose of such a case is to carry papers and other items, the businessperson or student will often also use the case to carry a fresh pad of paper on which to write information. There are carrying cases in existence which are capable of carrying papers in an organized fashion and which have space to carry a fresh notepad of paper and other items, such as pens, etc.

These carrying cases, however, have one significant drawback—the only place within the carrying case to carry the fresh pad of paper is within the central interior of the carrying case, together with the other papers and materials, which are also contained within the interior of the carrying case. Thus, in these existing carrying cases, if the user of the carrying case wishes to write something onto a fresh piece of paper contained on a notepad within the carrying case, the user will have to open the interior of the carrying case, thereby exposing the papers and other materials contained therein. By opening the interior of the carrying case, the user runs the risk of having the papers contained within the interior of the carrying case fall out of the case, even when the user simply wants to write something down on the notepad.

Further, the writing surfaces of many desks, usually those used in a school or lecture hall, are only large enough to hold a single sheet of paper; they are not large enough to hold both sides of the carrying case when it is opened to expose the interior of the case where the user will be writing on the notepad contained inside. Thus, the user must accommodate these smaller desks while writing on the notepad contained inside the case by folding the case behind on itself, or allowing one side of the case to fall over the edge of the desk. Using these carrying cases on such smaller desks thus exposes the papers and other items contained within the case to the additional risk that the papers and other items contained within the case will fall out of the case.

Accordingly, it will be appreciated from the foregoing that there is a definite need for an improved carrying case which is capable of storing a pad of fresh writing paper, wherein the notepad may be stored in a pocket that will enclose the notepad and protect it from the outside elements. The notepad should be easily accessible to the user, without disturbing the other papers and materials maintained within the carrying case. In other words, the user should be able to write upon the fresh pad of paper without having to open the case to expose the papers contained within the interior of the case. Further, the carrying case should be sturdy enough so that the user can have a sufficiently stable surface to write upon the notepad when it is exposed from its pocket. The present invention meets these needs.

SUMMARY OF THE INVENTION

In accordance with the present invention, an improved carrying case is provided which is capable of storing a pad of fresh writing paper, wherein the notepad may be stored in a pocket that will enclose the notepad and protect it from being exposed to the outside elements. The notepad is easily accessible to the user, without having to open the case to expose the papers contained within the interior of the case. Thus, the user may write upon the fresh paper without opening the interior of the carrying case. Further, the carrying case is sturdy enough so that the user can have a sufficiently stable surface to write upon the notepad when it is exposed from its pocket.

The carrying case of the present invention preferably has a first side panel, a second panel, and a middle panel connected together to define an interior capable of holding papers. The interior is adapted to contain papers and preferably has a three-ring binder attached to the inner surface of the third panel for holding the papers as in a three-ring notebook. Thus, the carrying case is capable of carrying papers that are three-hole punched. The papers are maintained within the interior of the case without being exposed to the outside element by the fact that the first and second panels may be sealed together by the use of a sealing element. The sealing element is preferably a zipper.

The outer surface of the first panel preferably has a first piece of fabric attached thereto. This fabric preferably forms a pocket on the outer surface of the first panel. This pocket is preferably adapted to contain a pad of paper. The outer edge of the pocket and the outer surface of the first panel are preferably sealed together by a sealing element thereby sealing the notepad within the interior of the pocket and protecting the notepad from being exposed to the outside elements. The sealing element is preferably a zipper as well.

Further, there is preferably a second piece of fabric attached to the outer surface of the first panel which is located within the interior of the first pocket and which forms an interior second pocket which is adapted to accept the backing of a pad of paper. Thus, the notepad, which has a stiff cardboard backing may be held in place within the second pocket by placing the backing within the pocket formed by the second piece of fabric.

The panels of the carrying case of the present invention are preferably formed from sturdy cardboard or any other strong, but lightweight, material. This material is covered in its entirety with a fabric covering to protect the material of the panels and to provide a lightweight covering. The fabric is preferably a canvas material or other natural or synthetic material that will provide a pleasing exterior that is strong and preferably waterproof. The fact that the panels are formed from a stiff material such as cardboard provides a sturdy writing surface for the notepad contained within the pocket.

Other objects, features, and advantages of the present invention will become apparent from a consideration of the following detailed description and from the accompanying drawings.

BRIEF DESCRIPTION OF THE DRAWINGS

FIG. 6 is a top plan view thereof; and

FIG. 7 is a bottom plan view thereof.

DETAILED DESCRIPTION OF THE PREFERRED EMBODIMENTS

Figure 1:
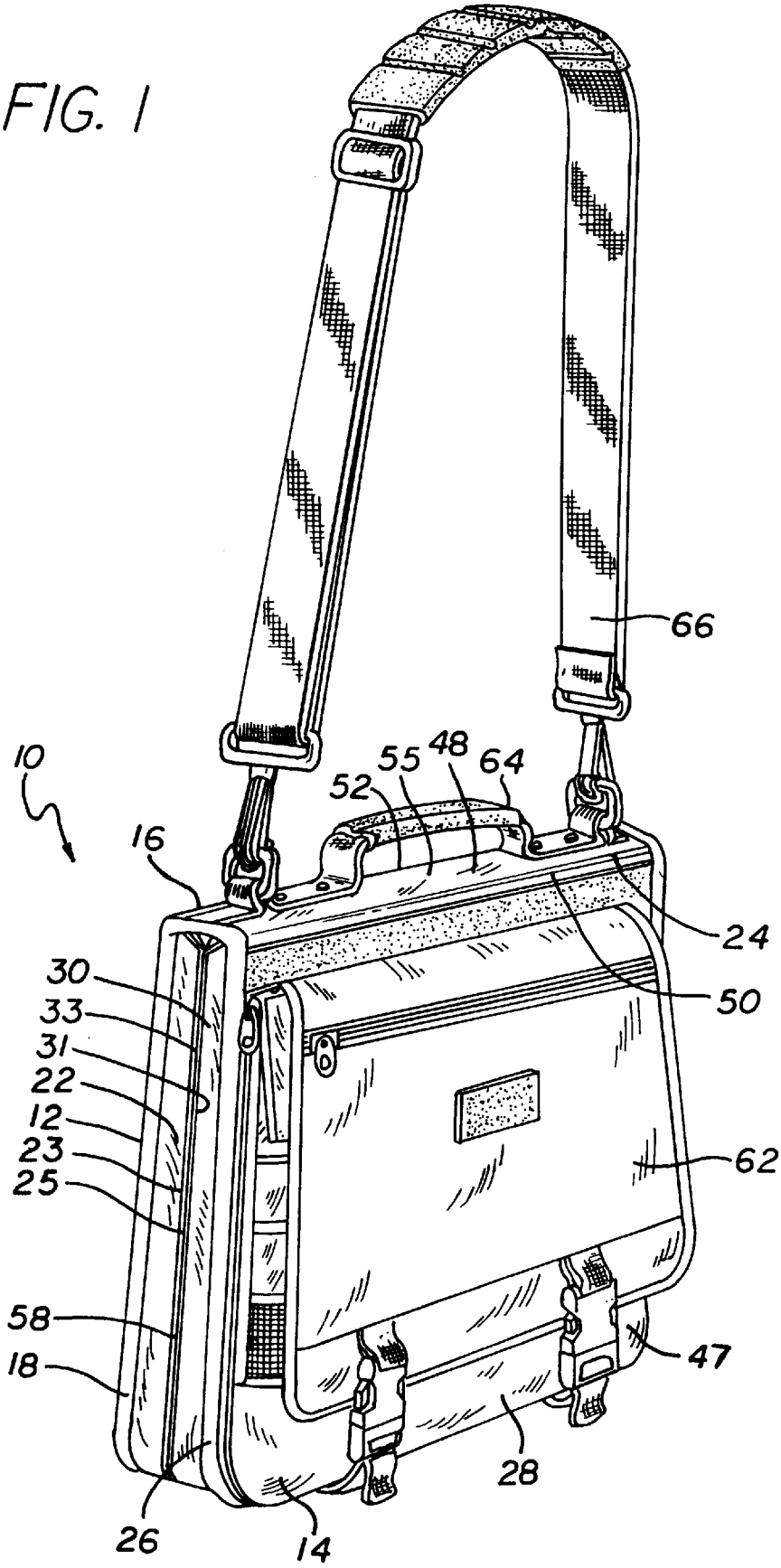
FIG. 1 is a front, side perspective view of a carrying case made in accordance with the present invention.

The present invention is embodied in an improved carrying case which is capable of storing a pad of fresh writing paper, wherein the pad may be stored in a pocket that will enclose the pad and protect it from being exposed to the outside elements. In addition to the benefit of providing a notepad that is contained in a pocket which may be selectively enclosed from the elements, the carrying case of the present invention provides the benefits that the notepad is easily accessible to the user, without having to open the case to expose the papers contained within the interior of the case. In other words, the user may write upon the fresh pad of paper without opening the interior of the carrying case. Further, the carrying case is sturdy enough so that the user can have a sufficiently stable surface to write upon the notepad without removing the notepad from its pocket.

In the particular embodiments shown in the drawings and herein described, the carrying case 10 of the present invention comprises a first and second side panel, 12 and 14, respectively. (See FIGS. 1–10). The first side panel 12 preferably has a connecting edge 16, a side edge 18, an outer surface 20, and an inner surface 21. The side edge 18 of the first side panel 12 is preferably connected to an outer side wall 22. Likewise, the second side panel 14 preferably has a connecting edge 24, a side edge 26, an outer surface 28, and an inner surface 29. The side edge 26 of the second side panel 14 is preferably connected to an outer side wall 30. The first and second side panels, 12 and 14, are preferably rectangularly-shaped and are preferably of the same size. The first and second side panels are preferably of a size that is greater than 8.5 inches by 11 inches so that papers of that size may be easily accommodated within the interior of the carrying case.

The first and second side panels, 12 and 14, are preferably formed from a cardboard or other lightweight, sturdy material. The first and second side panels, however, may be formed from any material that is sturdy and is lightweight, as is well-known by those of skill in the art. The panels should be sturdy and strong enough to protect the papers that will be contained within the carrying case, and should be sturdy enough to provide a suitable writing surface.

The cardboard or other material of the first and second panels, 12 and 14, are also preferably covered in their entirety on their outer surfaces, 20 and 28, and inner surfaces, 21 and 29, with a fabric covering. The fabric is preferably a thick, strong canvas material, which will protect the panels and the papers that are contained within the carrying case from the outside elements, while providing a pleasing, aesthetic look to the case. Again, the fabric material covering the panels may be any lightweight natural or synthetic fabric that is capable of protecting the panels and the papers contained within the carrying case, as is well-known to those of skill in the art.

The carrying case 10 includes an interior 46 for carrying papers. (See FIG. 8). The interior is formed by the first panel, the second panel, and a third or middle panel 48. The third or middle panel 48 has a first and second connecting edge, 50 and 52, respectively. The connecting edge 16 of the first side panel 12 is connected to the first connecting edge 50 of the middle panel 48 and the connecting edge 24 of the second panel 14 is connected to the second connecting edge 52 of the middle panel 48. Thus, the connection of the first and second panels, 12 and 14, to the middle panel 48 forms the interior 46 and exterior 47 of the carrying case.

The middle panel 48 is also preferably formed from a cardboard or other lightweight material, as with the first and second panels, as described above. The middle panel 48 may be formed from any material that is sturdy and is lightweight, as is well-known by those of skill in the art. The middle panel is sturdy and strong enough to protect the papers and provide a backbone for the carrying case. The cardboard or other material of the middle panel also preferably covered in their entirety with a fabric covering, as with the first and second panels, as described above.

The connection of the first panel 12 to the middle panel 48 and the connection of the second panel 14 to the middle panel 48 preferable permits the first and second panels to be moved relative to the middle panel. The fabric that forms the outer surface of the first, second, and middle panels, 20, 28 and 55, respectively, and the fabric which forms the inner surface of the first, second, and middle panels, 21, 29 and 54, respectively, are stitched together in the space between the cardboard of the first panel 12 and the cardboard of the middle panel 48 and in the space between the cardboard of the second panel 14 and the cardboard of the middle panel 48. Thus, this configuration permits the first and second panels, 12 and 14, to be moved relative to the middle panel 48 and thereby expose the interior 46 of the carrying case to permit the user of the case to have access to the papers contained within the interior and to permit the user to open the carrying case onto a flat surface such as a desk so that the exterior of the case lays flat on the flat surface.

The middle panel has an inside surface 54. There is preferably a three binder 56 attached by rivets to the inside surface of the middle panel 54. The three-ring binder is used to hold papers within the interior 46 of the carrying case. These papers preferably have three holes punched along one edge so that they may be held within the interior of the carrying case. Instead of a three-ring binder on the inside surface 54 of the middle panel 48, there may also be any other type of binder for holding papers, as is well-known to those of skill in the art.

The first panel 12 is preferably selectively sealable by a sealing element 58 to the second panel 14 in order to enclose the interior 46 of the carrying case 10 and to permit the carrying case to be moved from an opened position to a closed position and vice versa. (See FIGS. 1, 3, 4, and 8). As discussed above, the side edge 18 of the first side panel 12 is connected to an outer side wall 22 and the side edge 26 of the second side panel 14 is connected to an outer side wall 30. The outer side walls 22 and 30 of the first and second side panels 12 and 14 each have an outer edge, 23 and 31, respectively. The sealing element 58 is preferably a zipper wherein the outer edge of each has one corresponding side of a zipper, 25 and 33 attached thereto. The side of the zipper 25 of the outer side wall 22 of the first side panel 12 is engaged to the side of the zipper 33 of the outer side wall 30 of the second side panel 14 when the case 10 is in its closed position. (See, FIGS. 1, 3 and 4.) Thus, when the zipper, 25 and 33, is engaged, the carrying case is in its closed position and the papers are safely contained within its interior, while the first pocket containing the notepad is located on the outer surface of the first panel, as will be described below. The carrying case 10 is moved to its opened position (See FIG. 8) when the user disengages the zipper, 25 and 33, connecting the outer side walls, 22 and 30, of the first and second side panels, 12 and 14, thereby permitting the first and second side panels to be moved relative to the middle panel 48, as described above.

The outer side walls, 22 and 30, of the first and second side panels, 12 and 14, are preferably formed from the same fabric material as is used to form the outer and inner surfaces of the first, second, and middle panels of the carrying case. The width of each of the outer side walls, 22 and 30, is equal to approximately one of the width of the middle panel 48, so that, when the carrying case 10 is in its closed position, the width of the surface formed by the outer side walls is approximately the same as the width of the middle panel. (See FIGS. 3 and 4).

The first panel 12 preferably has an outer surface 20. (See FIGS. 5 and 9). There is preferably a first pocket 34 attached to the outer surface 20 of the first side panel 12. The first pocket 34 is preferably formed from a flap of fabric 36 that is sewn or otherwise attached to the fabric of the outer surface 34 of the first panel 12. The fabric flap 36 of the first pocket 34 is preferably formed from the same strong, lightweight canvas used to cover the interior cardboard of the panel 12. This fabric is also preferably substantially waterproof to protect the notepad that will be stored within the first pocket 34.

The first pocket 34 is preferably adapted to fit a notepad. (See FIG. 9). The notepad 35 preferably has sheets of 8.5 inches by 11 inches paper 37 contained thereon and has a cardboard or other stiff material backing (not shown). Thus, the flap of fabric that forms the first pocket is preferably rectangularly-shaped with one of its longer edges being attached to the outside surface of the first panel. The first pocket 34 and the fabric flap preferably have a width that is greater than 8.5 inches and a length that is greater than 11 inches to be able to hold such a notepad 35.

The sheets of paper are preferably attached at their top edge to the backing of the notepad. (See FIG. 9). The notepad may, however, be any type of similar notepad of any size and shape such that the first pocket is adapted to fit such notepad within it.

The first pocket 34 preferably contains a second pocket 38 within the first pocket 34. The second pocket 38 is preferably another piece 40 of the same fabric that is sewn to the fabric of the outer surface 32 of the first panel 12. The fabric 40 of the second pocket 38 is preferably shaped to be adapted to contain the backing of a pad of paper. Thus, the second pocket 38 and the fabric forming the second pocket 40 are preferably rectangularly-shaped. The fabric 40 is preferably slightly shorter in length than the length of the notepad 35 and is sewn or otherwise attached to the fabric of the outer surface 20 of the first panel 12 along three of its sides, so that the backing of the notepad may be inserted within the second pocket.

The first pocket 34 is preferably selectively moveable from an opened position to a closed position by a sealing element 60. (Compare FIGS. 5 and 9). The sealing element 60 is preferably a zipper 44 wherein the fabric flap 36 of the first pocket 34 of the first side panel 12 has an outer edge 42, the outer edge having one side of a zipper 44 attached thereto and wherein the outer surface 28 of the first side panel 12 has the corresponding side of the zipper 44 attached thereto. The one half of the zipper 44 of the outer edge 42 of the first pocket 34 corresponds to and selectively attaches to the one half of the zipper 44 attached to the outer surface 32 of the first side panel 12. Thus, when the first pocket 34 is in its closed position (See FIG. 5), the two halves of the zipper 44 are attached, thereby providing an interior space for storing the notepad, which is substantially impermeable to the elements.

The first pocket 34 provides the benefits of holding a fresh pad of paper 37 within the carrying case 10, but in such a manner that the user does not have to open the interior 46 of the carrying case 10, thereby exposing the papers contained therein to the outside elements and to the possibility of being lost from the interior of the case, in order to write information onto the fresh pad of paper. Further, because the user does not have to open the interior of the carrying case in order to expose the fresh writing pad, the user can use the first side panel as a writing surface. The first side panel, being formed from sturdy cardboard provides a sturdy writing surface. Moreover, the user can write on the fresh pad of paper on a small surface such as a small desk in a lecture hall, without having to fold back or otherwise accommodate the two side panels of the carrying case.

Figure 2:
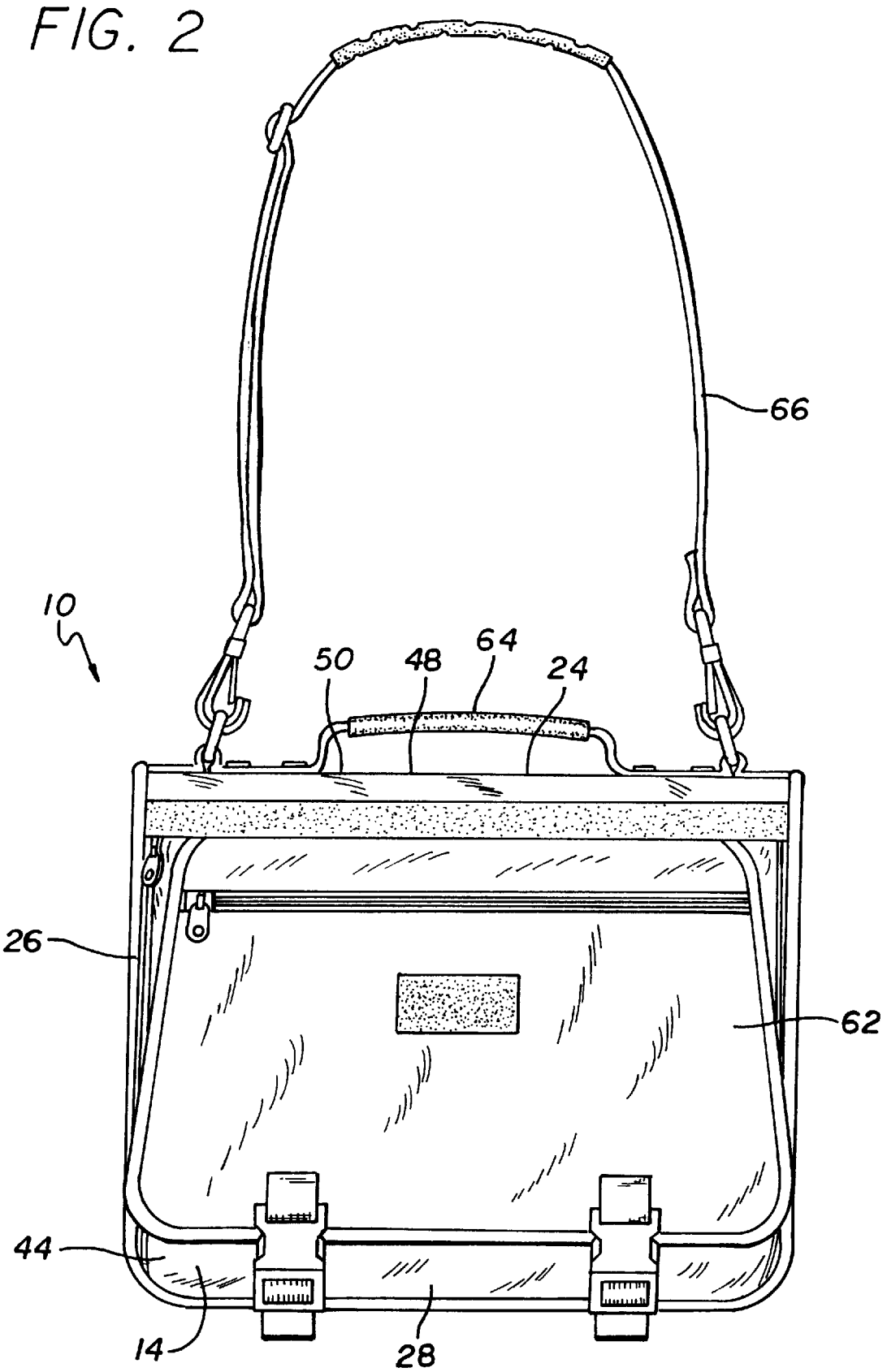
FIG. 2 is a front elevational view thereof.
Figure 3:
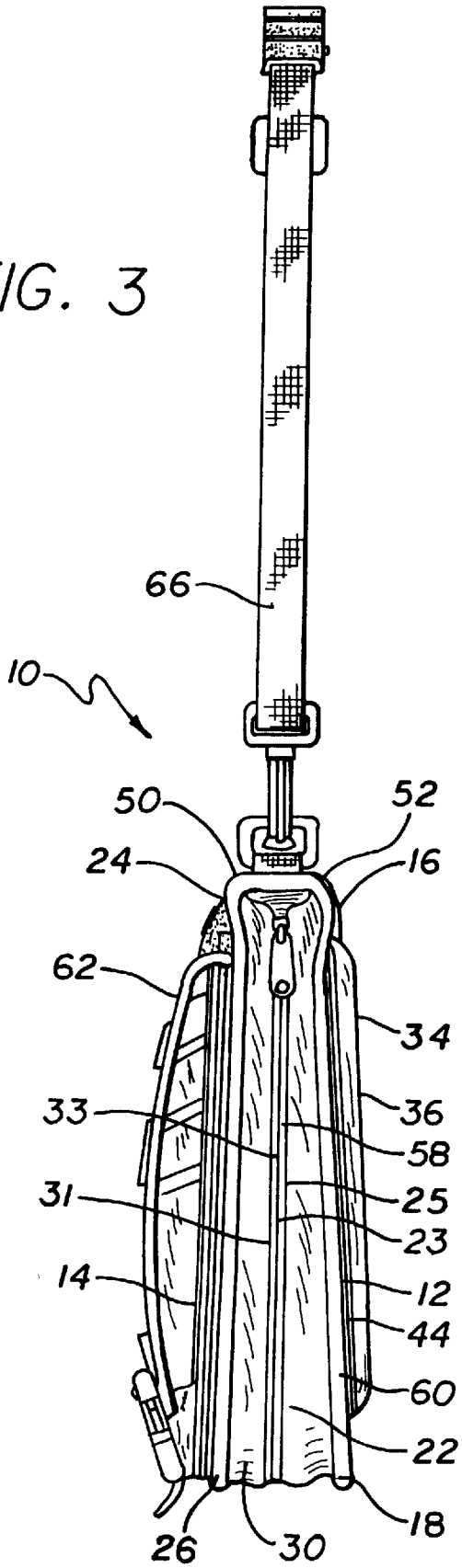
FIG. 3 is a left side view thereof.
Figure 4:
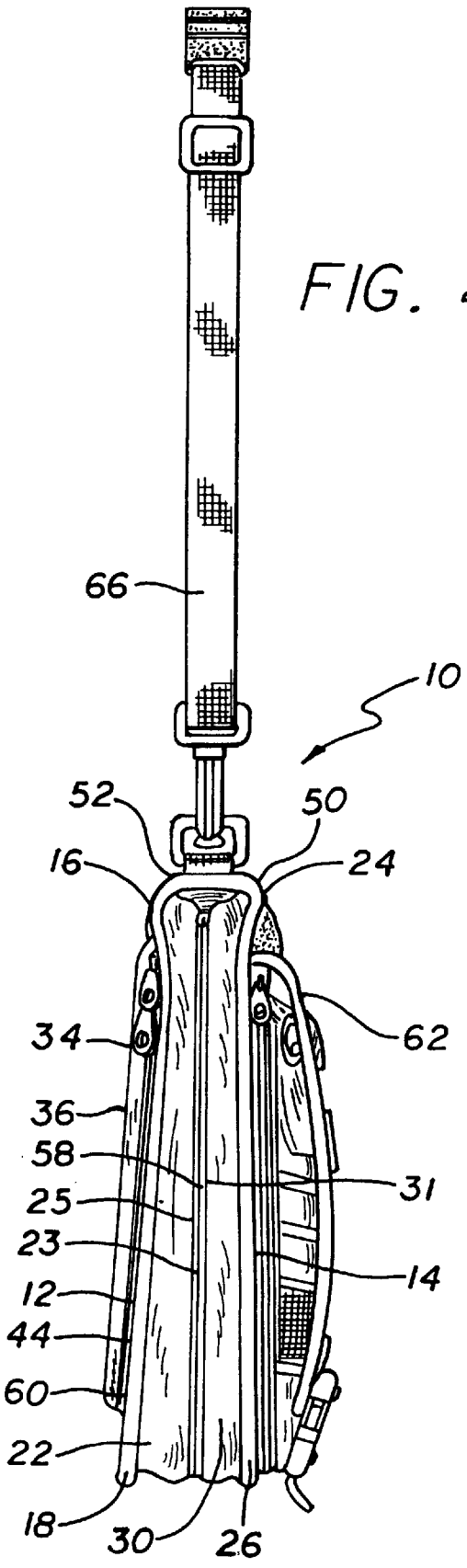
FIG. 4 is a right side view thereof.
Figure 5:
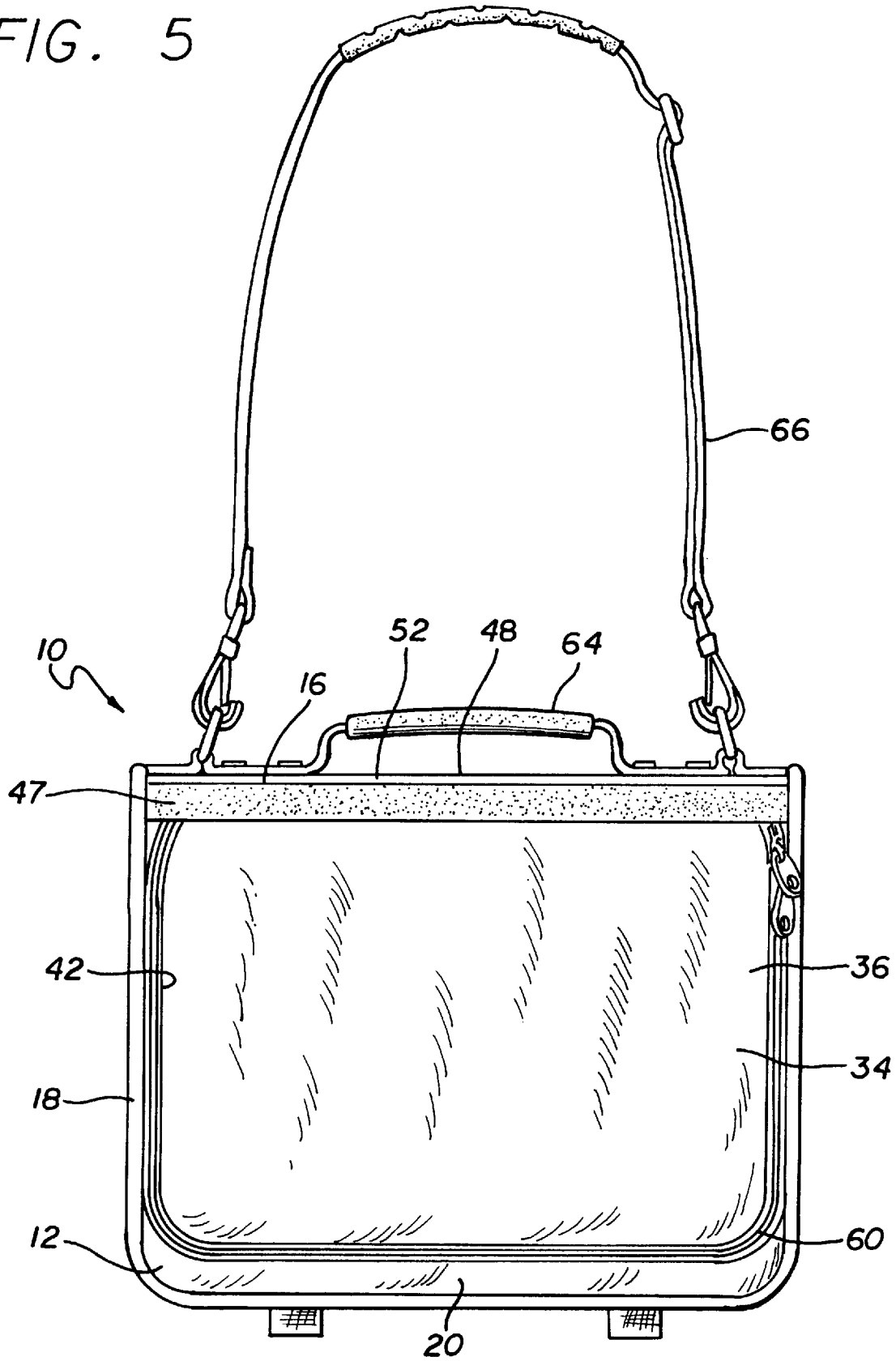
FIG. 5 is a rear elevational view thereof.
Figure 8:
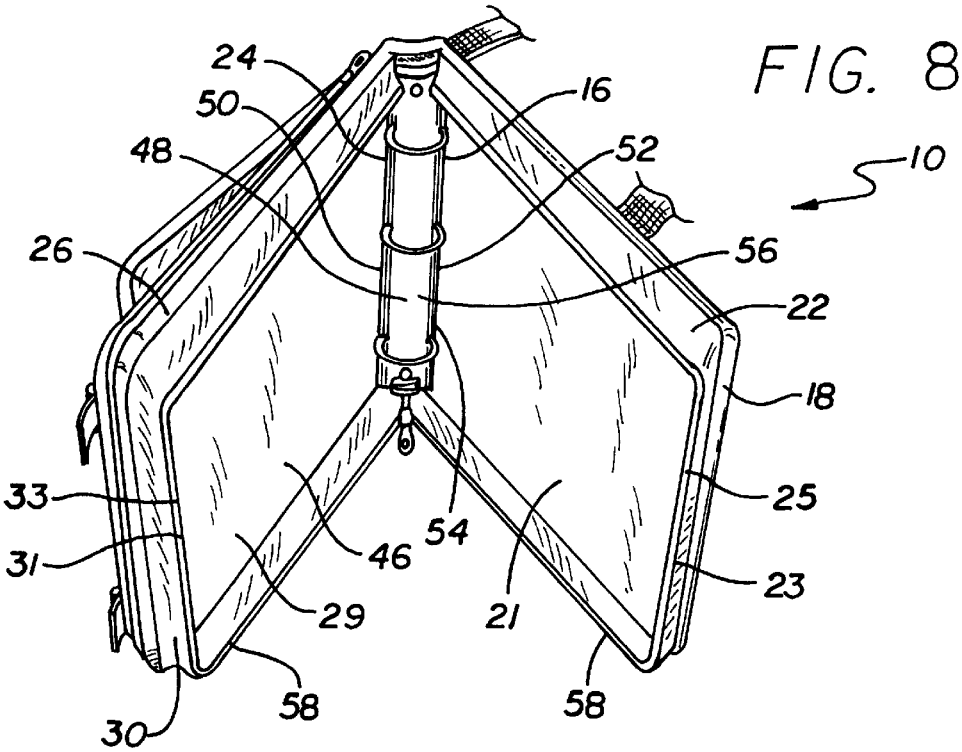
FIG. 8 is an elevational view showing the interior of the carrying case when the carrying case is in its opened position.
Figure 9:
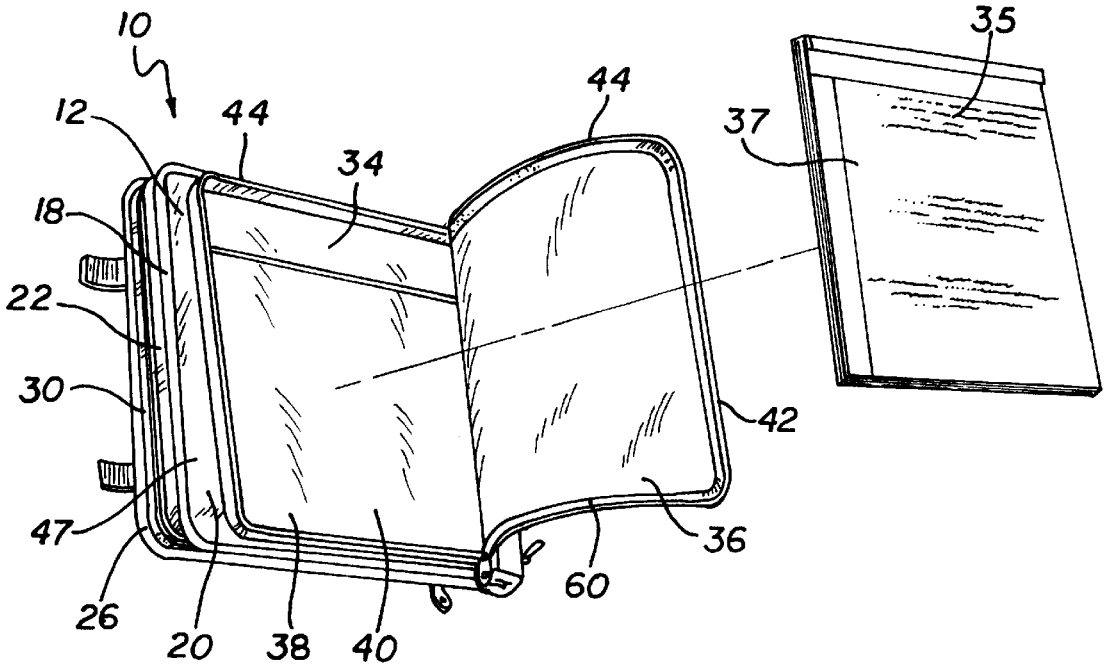
FIG. 9 is an elevational view showing the notepad and showing the notepad within the first pocket of the carrying case.
Figure 10:
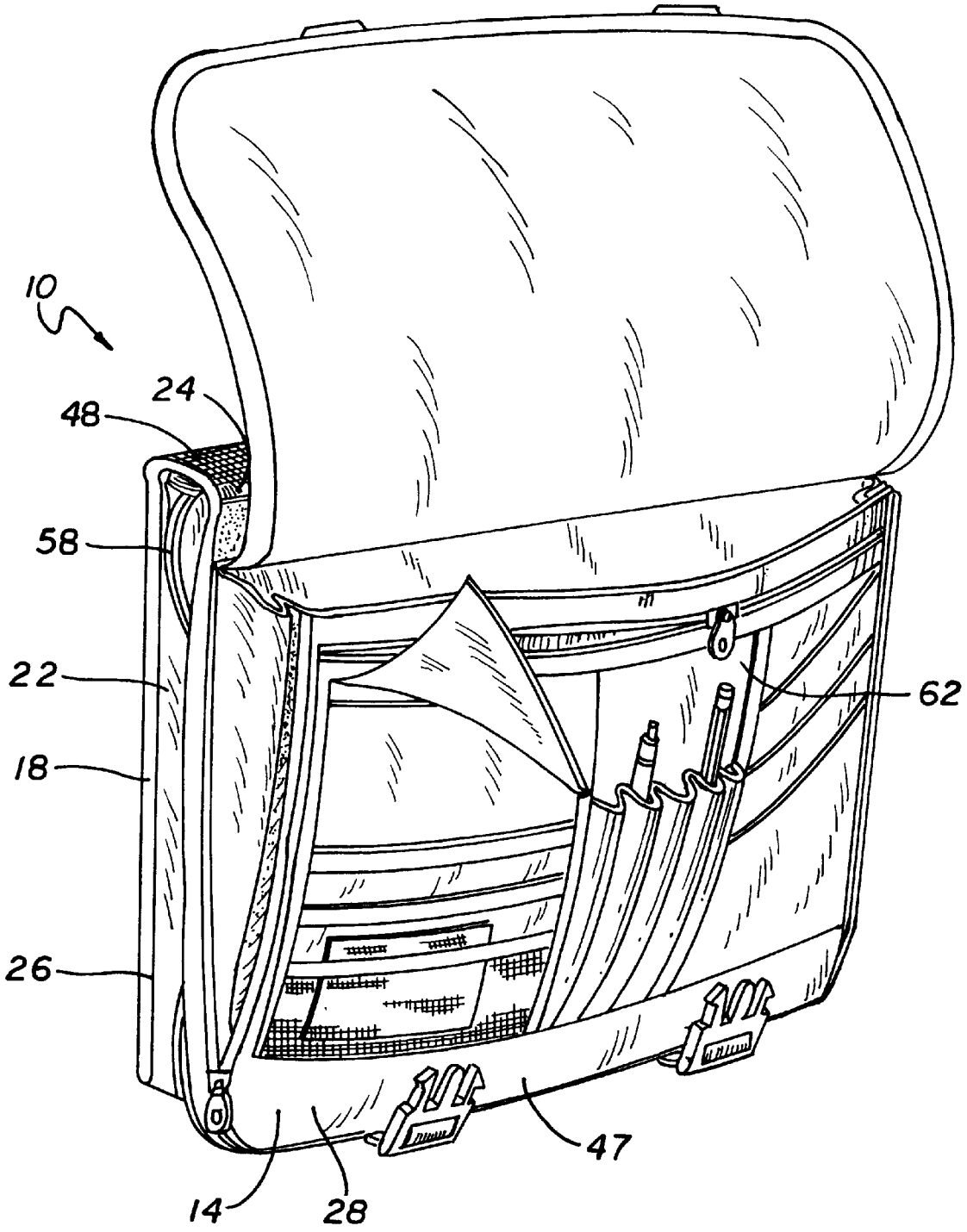
FIG. 10 is an elevational view showing the side flap of the carrying case in its opened position.

The carrying case may further include additional pockets 62 on the outer surface of the second side panel. (See FIGS. 1, 2, and 10). The pockets shown in FIGS. 1, 2, and 10 are exemplary of the pockets that may be included on the outer surface of the outer side panel. These additional pockets may be pockets for holding pens and pencils, calculators, business cards, and other such items. Any configuration, size and placement of pockets on the outer surface of the second side panel are within the scope of the invention.

The carrying case may further include a carrying handle 64 and shoulder strap 66 attached to the outer surface of the middle panel. (See FIGS. 1–6). The carrying handle 64 allows the user to carry the case 10 by hand, while the shoulder strap 66 allows the user to carry the case over his shoulder. The length of the shoulder strap 66 may be adjustable. The carrying handle 64 and shoulder strap 66 shown in FIGS. 1–6 are merely exemplary—any carrying handle and shoulder strap are within the scope of the invention.

While a particular form of the invention has been illustrated and described, it will be apparent that various modifications can be made without departing from the scope of the invention. For instance, the size and shape of the first, second, and middle panels, 12, 14, and 48, may differ depending on the size and shape of the papers to be placed within the interior of the case and the size and shape of the notepad 36 to be placed in the first pocket. Further, the materials used to form the first, second, and middle panels, 12, 14, and 48, may differ depending on the intended use of the carrying case. For instance, the panels may be formed from plastic and the panels may be connected by a hinge-type mechanism. Moreover, the carrying case may contain additional pockets within its interior and on its exterior, including a pocket within the first pocket that holds a pen and another pocket which holds a calculator so that the user has only to open the first pocket to have access to paper, pen, and a calculator. In addition, for example, the cover 36 may be selectively held in its closed configuration by Velcro®-type hook and loop pads or strips, instead of the zipper 60. Also, instead of a second pocket 38, the pad 35 may be held in place by clips or by a transverse strip or strips for receiving the backing of the pad or extending over the pad. Accordingly, it is not intended that the invention be limited by the specific embodiment disclosed in the drawings and described in detail hereinabove.

We claim:

1. A three-ring binder and notepad mounting assembly comprising:

a three-ring binder having an open and a closed configuration;

said three-ring binder having an outer cover, said cover having first and second sides;

a zipper secured to said cover for selectively holding said three-ring binder in the closed configuration;

a first pocket in one side of said cover, said first pocket having a flexible panel which may be folded back and being adapted to contain a pad of paper;

a zipper extending along three sides of said panel for selectively opening or closing said first pocket; and a second pocket located within the interior of said first pocket to receive a backing of said pad of paper; and whereby said first pocket may be opened by folding back said flexible panel to expose said pad for taking notes without fully opening said three-ring binder.

2. A case being selectively moveable from an opened position to a closed position, the case comprising:

a first side panel having a connecting edge, a side edge, and an outer surface, the side edge being connected to an outer side wall;

a second side panel having a connecting edge and a side edge, the side edge being connected to an outer side wall;

a first pocket attached to the outer surface of the first side panel, the pocket being adapted to contain a pad of paper and being selectively moveable from an opened position to a closed position, wherein the pocket of the first side panel has an outer edge, the outer edge having one side of a zipper attached thereto;

the pad of paper including a plurality of sheets of paper and a backing being attached to the plurality of sheets of paper;

a sheet material being attached to the outer surface of the first side panel and located within the first pocket, and forming a second pocket to receive a backing of the pad of paper; and a middle panel having a first and second connecting edge, the connecting edge of the first side panel being connected to the first connecting edge of the middle panel and the connecting edge of the second panel being connected to the second connecting edge of the middle panel, wherein the middle panel has an inside surface, the inside surface of the middle panel having a binder for releaseably securing a set of sheets attached thereto;

wherein the outer side wall of the first and second side panels each have an outer edge, the outer edge of each having one corresponding side of a zipper attached thereto, wherein the side of the zipper of outer side wall of the first side panel is connected to the side of the zipper of the outer side wall of the second side panel when the case in its closed position, and wherein the first side panel and the second side panel are rectangularly shaped and are of the same size.

3. The case of claim 2, wherein the binder is a three-ring binder.

4. A case as defined in claim 2 wherein said pocket has an outer flexible panel which may be folded back to fully expose said pad when said pocket is in the open position.

5. A case being selectively moveable from an opened position to a closed position, the case comprising:

a first side panel having a connecting edge and a side edge, the side edge being connected to an outer side wall, the first side panel having an outer surface and having a pocket on the outer surface, the pocket being selectively moveable from an opened position to a closed position, the pocket being adapted to contain a pad of paper, and the pocket has a second pocket contained therein, the second pocket being adapted to receive a backing of the pad of paper;

a second side panel having a connecting edge and a side edge, the side edge being connected to an outer side wall; and a middle panel having a first and second connecting edge, the connecting edge of the first side panel being connected to the first connecting edge of the middle panel and the connecting edge of the second panel being connected to the second connecting edge of the middle panel;

wherein the outer side wall of the first panel is connected to the outer side wall of the second panel when the case is in its closed position.

6. The case of claim 5, wherein the middle panel has an inside surface, the inside surface of the middle panel having a binder attached thereto.

7. The case of claim 6, wherein the binder is a three-ring binder.

8. The case of claim 6, wherein the second side panel has an outer surface having a pocket attached thereto, the pocket being selectively moveable from an opened position to a closed position.

9. The case of claim 5, wherein the first side panel and the second side panel are rectangularly shaped and are of the same size.

10. The case of claim 5, wherein the outer side wall of the first and second side panels each have an outer edge, the outer edge of each having a corresponding side of a zipper attached thereto, wherein the side of the zipper of the outer side wall of the first side panel is connected, to the side of the zipper of the outer side wall of the second side panel when the case is in its closed position.

11. The case of claim 10, wherein the first side panel and the second side panel are rectangularly shaped and are of the same size and wherein the side edge of the first and second panels comprise three sides of the rectangle.

12. The case of claim 5, wherein the pocket of the first side panel has an outer edge, the outer edge having one side of a zipper attached thereto and wherein the outer surface of the first side panel has the corresponding side of the zipper attached thereto, wherein the one half of the zipper of the outer edge of the pocket corresponds to and selectively attaches to the one half of the zipper attached to the outer surface of the first side panel.

13. The case of claim 12, wherein the pocket of the first side panel is rectangularly shaped and wherein the zipper is attached to three sides of the rectangularly shaped pocket.

14. The case of claim 5, wherein the second pocket is comprised of a rectangular piece of fabric that is attached at three sides to the outer surface of the first side panel.

15. The case of claim 5, wherein the first and second side panels are formed from cardboard and wherein the first and second side panels are covered with a fabric.

16. The case of claim 15, wherein the outer side wall of the first and second panels are made of fabric.

17. The case of claim 5, wherein the middle panel has an outside surface, the outside surface having a carrying strap attached thereto.

18. A case for holding papers within its interior, the case being capable of providing a pad of paper on a flat, sturdy surface while maintaining the papers within its closed interior, the case comprising:

a first, second, and third panel connected together to define an interior capable of holding papers, wherein the first panel is foldably connected to the second panel and the third panel is also foldably connected to the second panel, wherein the first and third panels have an outer surface, and wherein the first and third panels each have a sealing element for sealing the first and third panels together thereby sealing the interior from the outside elements;

a first piece of fabric attached to the outer surface of the first panel, the fabric forming a pocket on the outer surface of the first panel, the pocket having an opening and defining an interior, the pocket being adapted to contain a pad of paper, wherein the opening of the pocket and the outer surface of the first panel each have a sealing element for sealing the opening of the first pocket to the outer surface of the first panel thereby sealing the interior of the pocket from the outside elements;

a second piece of fabric attached to the outer surface of the first panel, the second piece of fabric being located within the interior of the first pocket and forming an interior being adapted to accept the backing of a pad of paper.

19. The case of claim 18, wherein the sealing element for sealing the first and third panels is a zipper.

20. The case of claim 18, wherein the sealing element for sealing the opening of the first pocket to the outer surface of the first panel is a zipper.

21. The case of claim 18, wherein the third panel has an outer surface having a carrying strap attached thereto.

* * * * *